US009404223B2

(12) United States Patent
Gray et al.

(10) Patent No.: US 9,404,223 B2
(45) Date of Patent: Aug. 2, 2016

(54) PROCESS FOR THE MANUFACTURE OF PAPER AND PAPERBOARD

(71) Applicant: BASF SE, Ludwigshafen (DE)

(72) Inventors: Christopher Alan Gray, Limburgerhof (DE); Antonius Moormann-Schmitz, Gruenstadt (DE); Hubert Meixner, Ludwigshafen (DE); Luis Miguel Sanchez Cerro, Heidelberg (DE); Christian Jehn-Rendu, Pudong New Area (CN); Thomas Muehlenbernd, Heidelberg (DE)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 14/373,174

(22) PCT Filed: Jan. 31, 2013

(86) PCT No.: PCT/EP2013/051921
§ 371 (c)(1),
(2) Date: Jul. 18, 2014

(87) PCT Pub. No.: WO2013/113823
PCT Pub. Date: Aug. 8, 2013

(65) Prior Publication Data

US 2014/0367059 A1 Dec. 18, 2014

(30) Foreign Application Priority Data

Feb. 1, 2012 (WO) ..... PCT/CN2012/070821

(51) Int. Cl.

| | |
|---|---|
| ***D21H 17/44*** | (2006.01) |
| ***D21H 17/45*** | (2006.01) |
| ***D21H 21/10*** | (2006.01) |
| ***D21H 17/37*** | (2006.01) |
| ***D21H 27/30*** | (2006.01) |
| ***D21H 17/00*** | (2006.01) |
| *D21H 17/36* | (2006.01) |
| *D21H 17/56* | (2006.01) |
| *D21H 23/26* | (2006.01) |

(52) U.S. Cl.
CPC ..... *D21H 27/30* (2013.01); *D21H 17/375* (2013.01); *D21H 17/74* (2013.01); *D21H 21/10* (2013.01); *D21H 17/36* (2013.01); *D21H 17/56* (2013.01); *D21H 23/26* (2013.01)

(58) Field of Classification Search
CPC ..... D21H 21/10; D21H 17/455; D21H 23/14; D21H 17/375; D21H 17/37; D21H 17/56; D21H 17/68; D21H 17/44; D21H 17/55; D21H 17/45; D21H 17/74; D21H 17/36; D21H 17/67; D21H 17/63; D21H 23/26
See application file for complete search history.

(56) References Cited

U.S. PATENT DOCUMENTS

| | | | | |
|---|---|---|---|---|
| 4,144,123 | A | 3/1979 | Scharf et al. | |
| 4,388,150 | A | 6/1983 | Sunden et al. | |
| 4,421,602 | A | 12/1983 | Brunnmueller et al. | |
| 4,913,775 | A * | 4/1990 | Langley et al. | 162/164.3 |
| 4,946,557 | A | 8/1990 | Svending | |
| 5,126,014 | A | 6/1992 | Chung | |
| 5,176,891 | A | 1/1993 | Rushmere | |
| 5,185,062 | A * | 2/1993 | Begala | 162/168.1 |
| 5,482,693 | A | 1/1996 | Rushmere et al. | |
| 5,536,370 | A | 7/1996 | Scherr et al. | |
| 5,641,855 | A | 6/1997 | Scherr et al. | |
| 5,858,174 | A | 1/1999 | Persson et al. | |
| 5,876,563 | A * | 3/1999 | Greenwood | 162/175 |
| 5,902,455 | A * | 5/1999 | Hund et al. | 162/164.1 |
| 6,103,065 | A | 8/2000 | Humphreys et al. | |
| 6,132,558 | A * | 10/2000 | Dyllick-Brenzinger et al. | 162/164.6 |
| 6,475,341 | B1 * | 11/2002 | Johnston et al. | 162/183 |
| 6,616,807 | B1 * | 9/2003 | Dyllick-Brenzinger et al. | 162/175 |
| 6,706,190 | B1 | 3/2004 | Steuerle et al. | |
| 7,388,025 | B2 | 6/2008 | Buettelmann et al. | |
| 7,815,771 | B2 * | 10/2010 | Faucher et al. | 162/158 |

(Continued)

FOREIGN PATENT DOCUMENTS

| | | |
|---|---|---|
| CN | 1287585 A | 3/2001 |
| CN | 1675432 A | 9/2005 |

(Continued)

OTHER PUBLICATIONS

International Search Report and Written Opinion issued Jul. 31, 2013 in PCT/EP2013/051921.

(Continued)

*Primary Examiner* — Jose Fortuna
(74) *Attorney, Agent, or Firm* — Oblon, McClelland, Maier & Neustadt, L.L.P.

(57) ABSTRACT

The present invention relates to a process of making paper or paperboard in which a cellulosic thin stock is provided and subjected to one or more shear stages and then drained and a moving screen to form a sheet which is dried, wherein the process employs a retention system which is applied to the thin stock, said retention system comprising as components i) a blend of different cationic polymers and ii) a microparticulate material, in which the blend of cationic polymers comprises, a) a cationic polymer having a charge density of at least 3 mEq per gram and a molar mass of greater than 700,000 Da, b) a cationic polymer having a charge density of below 3 mEq per gram and an intrinsic viscosity of at least 3 dl/g, wherein one of the components of the retention system is dosed into the thin stock after the final shearing stage and the other is dosed into the thin stock before the final shearing stage.

19 Claims, No Drawings

(56) References Cited

U.S. PATENT DOCUMENTS

| | | | | |
|---|---|---|---|---|
| 7,918,965 | B2 * | 4/2011 | Leduc et al. | 162/168.1 |
| 7,998,314 | B2 * | 8/2011 | Koch et al. | 162/158 |
| 8,152,962 | B2 * | 4/2012 | Koch et al. | 162/164.6 |
| 8,168,040 | B2 | 5/2012 | Reinicke | |
| 8,404,083 | B2 * | 3/2013 | Haehnle et al. | 162/164.6 |
| 8,454,796 | B2 * | 6/2013 | Reinicke | 162/164.6 |
| 8,926,797 | B2 * | 1/2015 | Jehn-Rendu et al. | 162/168.3 |
| 2003/0150575 | A1 * | 8/2003 | Hund et al. | 162/168.3 |
| 2004/0040683 | A1 * | 3/2004 | Hund et al. | 162/164.1 |
| 2005/0150622 | A1 * | 7/2005 | Hund et al. | 162/181.8 |
| 2005/0161183 | A1 | 7/2005 | Covarrubias | |
| 2005/0247420 | A1 | 11/2005 | Blum et al. | |
| 2006/0243407 | A1 * | 11/2006 | Hund et al. | 162/158 |
| 2007/0151688 | A1 | 7/2007 | Solhage et al. | |
| 2008/0287596 | A1 | 11/2008 | Wester et al. | |
| 2009/0283232 | A1 * | 11/2009 | Hund et al. | 162/164.6 |
| 2010/0084103 | A1 | 4/2010 | Reinicke | |
| 2010/0300633 | A1 | 12/2010 | Goto et al. | |
| 2010/0326615 | A1 | 12/2010 | Lu | |
| 2012/0227920 | A1 | 9/2012 | Juppo et al. | |
| 2014/0124155 | A1 | 5/2014 | Jehn-Rendu | |
| 2014/0367059 | A1 * | 12/2014 | Gray | D21H 17/375 162/127 |
| 2015/0027650 | A1 * | 1/2015 | Gray | D21H 17/44 162/164.2 |
| 2015/0345081 | A1 * | 12/2015 | Gray | D21H 17/45 162/168.3 |

FOREIGN PATENT DOCUMENTS

| | | | | |
|---|---|---|---|---|
| DE | 24 34 816 | A1 | 2/1976 | |
| EP | 0 071 050 | A1 | 2/1983 | |
| EP | 0 102 760 | A2 | 3/1984 | |
| EP | 0 102 760 | A3 | 3/1984 | |
| EP | 0 126 528 | A2 | 11/1984 | |
| EP | 0 126 528 | A3 | 11/1984 | |
| EP | 0 150 933 | A2 | 8/1985 | |
| EP | 0 150 933 | A3 | 8/1985 | |
| EP | 0 235 893 | A1 | 9/1987 | |
| EP | 0 335 575 | A2 | 10/1989 | |
| EP | 0 335 575 | A3 | 10/1989 | |
| EP | 0 484 617 | A1 | 5/1992 | |
| EP | 0 485 124 | A1 | 5/1992 | |
| EP | 0 752 496 | A2 | 1/1997 | |
| EP | 0 752 496 | A3 | 1/1997 | |
| EP | 0 910 701 | A1 | 4/1999 | |
| EP | 2 157 237 | A1 | 2/2010 | |
| EP | 1 945 683 | B1 | 3/2010 | |
| EP | 1 948 648 | B1 | 5/2010 | |
| EP | 2 319 984 | A1 | 5/2011 | |
| WO | WO 86/00100 | A1 | 1/1986 | |
| WO | WO 94/12560 | A1 | 6/1994 | |
| WO | WO 94/14873 | A1 | 7/1994 | |
| WO | WO 9716598 | A1 * | 5/1997 | D21H 21/10 |
| WO | WO 97/23567 | A1 | 7/1997 | |
| WO | WO 97/25367 | A1 | 7/1997 | |
| WO | WO 97/33040 | A1 | 9/1997 | |
| WO | WO 97/33041 | A1 | 9/1997 | |
| WO | WO 98/01623 | A1 | 1/1998 | |
| WO | WO 99/16708 | A1 | 4/1999 | |
| WO | WO 9961702 | A1 * | 12/1999 | D21H 21/10 |
| WO | WO 9963159 | A1 * | 12/1999 | D21H 23/76 |
| WO | WO 9966130 | A1 * | 12/1999 | D21H 23/76 |
| WO | WO 00/17450 | A1 | 3/2000 | |
| WO | WO 00/67884 | A1 | 11/2000 | |
| WO | WO 2005116336 | A1 * | 12/2005 | D21H 23/76 |
| WO | WO 2006064139 | A1 * | 6/2006 | D21H 21/10 |
| WO | WO 2006090076 | A1 * | 8/2006 | D21H 21/18 |
| WO | WO 2008/095769 | A1 | 8/2008 | |
| WO | WO 2010145956 | A1 * | 12/2010 | |
| WO | WO 2013127731 | A1 * | 9/2013 | |
| WO | WO 2014108844 | A1 * | 7/2014 | |

OTHER PUBLICATIONS

International Preliminary Report on Patentability issued Aug. 14, 2014 in PCT/EP2013/051921.

International Search Report and Written Opinion issued Nov. 8, 2012 in PCT/CN2012/070821.

Ying Huang, et al., "Synthesis and characterization of bisacrylamide microgels containing sulfo groups", Makromol. Chem., vol. 186, 1985, pp. 273-281.

U.S. Appl. No. 14/378,059, filed Aug. 11, 2014, Gray.

U.S. Appl. No. 14/760,381, filed Jul. 10, 2015, Gray, et al.

Combined Office Action and Search Report issued Nov. 20, 2015 in Chinese Patent Application No. 201380007658.9 (with partial English language translation and English Translation of Category of Cited Documents).

* cited by examiner

PROCESS FOR THE MANUFACTURE OF PAPER AND PAPERBOARD

CROSS REFERENCE TO RELATED APPLICATIONS

The present application is a 35 U.S.C. §371 national stage patent application of International patent application PCT/EP2013/051921, filed on Jan. 31, 2013, published as WO/2013/113823 on Aug. 8, 2013, the text of which is incorporated by reference, and claims the benefit of the filing date of application no. PCT/CN2012/070821, filed on Feb. 1, 2012, the text of which is also incorporated by reference.

BACKGROUND OF THE INVENTION (1) Field of the Invention

The present invention relates to a method for the manufacture of paper and paperboard from a cellulosic suspension, employing a novel retention system.

(2) Description of the Background Art

It is well known to manufacture paper by a process that comprises flocculating a cellulosic thin stock by the addition of polymeric retention aid and then draining the flocculated suspension through a moving screen (often referred to as a machine wire) and then forming a wet sheet, which is then dried.

In order to increase output of paper many modern paper making machines operate at higher speeds. As a consequence of increased machine speeds a great deal of emphasis has been placed on drainage and retention systems that provide increased drainage. However, it is known that increasing the molecular weight of a polymeric retention aid which is added immediately prior to drainage will tend to increase the rate of drainage but damage formation. It is difficult to obtain the optimum balance of retention, drainage, drying and formation by adding a single polymeric retention aid and it is therefore common practice to add two separate materials in sequence.

EP-A-235893 provides a process wherein a water soluble substantially linear cationic polymer is applied to the paper making stock prior to a shear stage and then reflocculating by introducing bentonite after that shear stage. This process provides enhanced drainage and also good formation and retention. This process which is commercialised by BASF under the Hydrocol® (trade mark) has proved successful for more than two decades.

This Hydrocol® (trade mark) system of making paper is a very efficient microparticle system for a wide range of paper grades including liner board and folding box board production. The benefits of this system include high retention levels, good drainage, good formation, good machine cleanliness, good runnability and a cost efficient system.

Subsequently, various attempts have been made to provide variations on this theme by making minor modifications to one or more of the components.

EP-A-335575 describe such a process in which a main polymer selected from cationic starch and high molecular weight water-soluble cationic polymer is added to a cellulosic suspension after which the suspension is passed through one or more shear stages followed by the addition of inorganic material selected from bentonite and colloidal silica. In this system a low molecular weight cationic polymer is added into the suspension before the addition of the main polymer. It is indicated that the low molecular weight polymer usually has a molecular weight below 500,000 and usually above 50,000, often above 100,000. Suggested low molecular weight cationic polymers include polyethyleneimine, polyamines, polymers of dicyandiamidesformaldehyde, polymers and copolymers of diallyl dimethyl ammonium chloride, of dialkyl amino alkyl (meth) acrylates and of dialkyl amino alkyl (meth) acrylamides (both generally as acid addition or quaternary ammonium salts). The process was said to improve processes in which there is a high amount of pitch or processes with a high cationic demand.

A further development of this type of process was subsequently disclosed in EP-A-910701 in which two different water-soluble cationic polymers or added in succession to pulps followed by subjecting the pulps to at least one shearing stage followed by the addition of bentonite, colloidal silica or clay. Specifically polyethyleneimines having a molar mass of more than 500,000 or polymers containing vinyl amine groups having a molar mass of between 5000 and 3 million are added to the pulp and then high molecular weight cationic polyacrylamides.

EP-A-752496 discloses a papermaking process in which a low molecular weight cationic polymer having a molecular weight below 700,000 and a cationic and/or amphoteric high molecular weight polymer are added simultaneously to the thin stock with anionic inorganic particles such as silica or bentonite being dosed into the thin stock suspension. The low molecular weight cationic polymer includes polyethyleneimine and polyvinyl amine. The polymers are generally added separately although it is indicated that the two cationic polymers can be added as a mixture. It is also indicated that the polymers can be added before a shear stage although the exact addition points are not indicated. It is stated that this process results in improved drainage and/or retention compare to processes in which the high molecular weight cationic or amphoteric polymer is used alone in conjunction with anionic inorganic particles.

U.S. Pat. No. 6,103,065 discloses a papermaking process involving the addition to a paper stock after the last point of high shear at least one high charge density cationic polymer of molecular weight between 100,000 and 2 million with a charge density in excess of 4 mEq per gram and either concurrently or subsequently adding at least one polymer having a molecular weight more than 2 million with a charge density below 4 mEq per gram. Subsequent to the two polymers a swellable bentonite clay is added to the stock. The high charge density polymer can be polyethyleneimine homopolymers or copolymers or polymers produced from vinyl amines. This document indicate that the process improves conventional bentonite programs by employing less polymer and improving press section dewatering which increases the solids entering the dryers thereby reducing the drying requirements. However, this process can sometimes suffer the disadvantage when making fine paper of a yellowing tendency.

A particular disadvantage of many conventional microparticle systems is that drainage tends to increase simultaneously with increasing retention. Although this may have been perceived as an advantage several years ago, with modern high-speed paper machines very high drainage can be a disadvantage. This can be the case for gap former machines and multi-ply fourdrinier machines. Folding box board is normally produced on multi-ply fourdrinier machines in which the major ply is the middle layer (typically about 150 to 400 g/m2). The requirements for these grades are good retention for the lower basis weight and good drainage for the high basis weight. Nevertheless in most cases it is necessary to reduce the paper machine speed for the higher basis weight sheets because of these drainage limitations. In many cases simply increasing the retention aid components the drainage on the wire can be improved but the water release in the press tends to be reduced. Further, formation can also be adversely affected.

It would be desirable to provide an improved process for making paper and board. Furthermore, it would be desirable to overcome the aforementioned disadvantages.

SUMMARY OF THE INVENTION

According to the present invention we provide a process of making paper or paperboard in which a cellulosic thin stock is provided and subjected to one or more shear stages and then drained and a moving screen to form a sheet which is dried, wherein the process employs a retention system which is applied to the thin stock, said retention system comprising as components, i) a blend of different cationic polymers and ii) a microparticulate material, in which the blend of cationic polymers comprises, a) a cationic polymer having a charge density of at least 3 mEq per gram and a molar mass of greater than 700,000 Da, b) a cationic polymer having a charge density of below 3 mEq per gram and an intrinsic viscosity of at least 3 dl/g, wherein one of the components of the retention system is dosed into the thin stock after the final shearing stage and the other is dosed into the thin stock before the final shearing stage.

The inventors found that the process of the present invention conveniently allows for the machines speed to be increased, especially when making board, such as folding box board. Additionally, the process allows improved retention without necessarily increasing drainage. Such an improvement may be regarded as a decoupling effect between retention and drainage. Further, the process appears to allow runnability. The sheets of paper and board produced by the process of the present invention also exhibit improved formation and strength. Furthermore, this process allows increased productivity of the paper and board.

DETAILED DESCRIPTION OF THE INVENTION

In the process of making paper or paperboard a cellulosic thin stock is typically made by first forming a thick stock suspension from stock material and water and then diluting this thick stock suspension with dilution water to form the cellulosic thin stock. The thin stock will be passed through one or more shear stages and then drained on a moving screen (often termed machine wire) to form a wet sheet which can then be dried. In the case of making paperboard several layers or plies may be combined to form a composite sheet. Typically, a thin stock suspension may have a stock consistency of between 0.1 and 3% solids on total weight of suspension.

In a process of making paper or paperboard there may be several shearing stages, selected from mixing, pumping and screening. Usual shearing stages include the one or more fan pumps or the one or more pressure screens. Typically the final shearing stage is often a pressure screen. Following this final shearing stage the thin stock may typically be fed into a headbox or constant flow box which delivers the thin stock onto the moving screen often termed machine wire.

The paper may be formed as single ply sheets. However, the process is particularly suitable for making multiple layer or multi-ply sheets, particularly in the case of board manufacture. The base weight of the respective layers may be the same, similar or different. In some cases, such as in the manufacture of folding box board it is the middle layer which has a higher base weight, for instance between 150 and 400 g/m2. The process of the present invention is particularly suitable for the manufacture of board.

According to the process of the present invention multi-ply least one of the retention components can be added after the final shearing stage whilst the other should be added before this point. It may be desirable to add the first retention component to the thin stock and then pass the so treated thin stock through more than one shear stage and then after the last shearing stage to add the other retention component.

It may be desirable in some cases to dose the microparticle material to the thin stock before the last shearing stage and then subsequent to this stage dosing the blend of cationic polymers. Nevertheless, it is preferred that the blend of cationic polymers is dosed into the thin stock before the final shearing stage and then the microparticle material dosed into the thin stock after the final shearing stage.

The cationic polymer of the blend which has a charge density of at least 3 mEq per gram may be any one of a number of types of cationic polymers provided that it has a molar mass greater than 700,000 Da. The molar mass may be as high as 3,000,000 Da but is generally up to 2,000,000 Da or 2,500,000 Da. Suitably the molar mass may be at least 750,000 Da and often at least 800,000 Da. Often the molar mass will be at least 900,000 Da or even at least 1,000,000 Da or in some cases at least 1,100,000 Da. The molar mass may for instance be between 1,000,000 Da and 2,000,000 Da, for instance 1,100,000 Da to 1,800,000 Da. The charge density may be at least 3.5 mEq per gram or in some cases at least 4 mEq per gram. The charge density may for instance be any value higher than this for instance up to 8 or 10 mEq per gram or higher. Suitably this cationic polymer may be any of the polymers generally described as polyethyleneimines, polyamines, polymers of dicyandiamides with formaldehyde or even cationic vinyl addition polymers. Typical cationic vinyl addition polymers would include polymers of water-soluble cationic ethylenically unsaturated monomers. Typical cationic ethylenically unsaturated monomers include dimethyl ammonium halide (e.g. chloride), acid addition or quaternary ammonium salts of dialkyl amino alkyl (meth) acrylates and acid addition or quaternary ammonium salts of dialkyl amino alkyl (meth) acrylamides. Such polymers may be homopolymers of one or more of the cationic monomers or copolymers of one or more cationic monomers with non-ionic ethylenically unsaturated. Other cationic polymers include polymers of vinyl carboxamides, such as N-vinyl formamide, followed by partial or complete hydrolysis to yield vinyl amine units. Preferred polymers are selected from the group consisting of amino-containing polymers, in particular polyethyleneimines, modified polyethyleneimines, polyvinylamines, and partially hydrolysed polyvinyl carboxamides.

Polyethyleneimines or modified polyethylenimines may be as defined below include the nitrogen-containing condensation products described in German laid-open specification DE 24 34 816. These are obtained by reacting polyamidoamine compounds with polyalkylene oxide derivatives whose terminal hydroxyl groups have been reacted with epichlorohydrin. Other suitable polyethyleneimines are described in WO 97/25367 A1, WO 94/14873 A1, and WO 94/12560 A1. The polyethyleneimines or modified polyethyleneimines may be subsequently subjected to ultrafiltration as described in WO 00/67884 A1 and WO 97/23567 A1. Suitable polyethyleneimines and modified polyethyleneimines include polyalkylenimines, polyalkylene polyamines, polyamidoamines, polyalkylene glycol polyamines, polyamidoamines grafted with ethylenimine and subsequently reacted with at least difunctional crosslinkers, and mixtures and copolymers thereof.

Another preferred category of cationic polymers of charge density of at least 3 mEq per gram include partially hydrolysed polyvinyl carboxamides. More preferably these cationic polymers are homopolymers or copolymers of N-vinylformamide. These may be obtained by polymerizing N-vinylformamide to give homopolymers or by copolymerizing N-vinylformamide together with at least one other ethylenically unsaturated monomer. The vinylformamide units of these polymers are not hydrolyzed, in contradistinction to the preparation of polymers comprising vinylamine units. The copolymers may be cationic, anionic or amphoteric. Cationic polymers are obtained, for example, by copolymerizing N-vinylformamide with at least one other compatible ethylenically unsaturated water-soluble monomer, for instance acrylamide. Such polymers may for instance be produced as in aqueous solution, as a powder, as a reverse-phase emulsion or dispersion or as an aqueous dispersion.

Polymers comprising vinylformamide units are known. For instance, EP-A 0 071 050 describes linear basic polymers comprising 90 to 10 mol % of vinylamine units and 10 to 90 mol % of vinylformamide units. These polymers are produced by polymerizing N-vinylformamide by the solution polymerization process in water, the inverse suspension polymerization process, the water-in-oil emulsion polymerization process or the precipitation polymerization process and, in each case, subsequent partial detachment of formyl groups from the polyvinylformamides to form vinylamine units.

It is also suitable to produce a polymer powder comprising vinylformamide units by free radical polymerization of an aqueous solution of N-vinylformamide and if appropriate other monomers and drying the polymer. Typically this comprises an aqueous monomer solution comprising N-vinylformamide and at least one polymerization initiator being spray dispensed as an aerosol or dropletized at the top of a heatable tower-shaped reactor. Then the aerosol or droplets are polymerised in an inert gas atmosphere to form a finely divided solid followed by discharging the finely divided polymer from the reactor. This is for instance described in EP 1948648.

Another particularly desirable form of such poly vinyl carboxamides includes aqueous dispersions. Such a aqueous dispersions of water-soluble polymers of N-vinylcarboxamides, may be characterised in being substantially salt-free and comprising anionic polymeric stabilizers having a comb-like molecular structure. The aqueous dispersions may contain at least one polymeric stabilizer having a comb-like molecular structure, which is obtained by copolymerization of monomer mixtures comprising macromonomers and which is present as an anion under the polymerization conditions. The structure of the stabilizers can be described, for example, as a hydrocarbon backbone with anionic groups and nonpolar polyalkylene glycol side chains. In the aqueous polymerization medium, these stabilizers act, for example, as a stabilizer and/or as a precipitating agent for the polymer particles forming. These polymers may be obtained by copolymerization of monomer mixtures comprising macromonomers, for example as described in EP 1945683.

Mixtures of from 50 to 100% by weight of N-vinylformamide and from 0 to 50% by weight of one or more of said comonomers are suitable for the preparation of the water-soluble N-vinylcarboxamide polymers. The aqueous dispersions may be substantially salt-free. Here, "substantially salt-free" means that any amount of inorganic salts which is still present in the dispersions is very small, preferably less than about 1% by weight, particularly preferably less than 0.5% by weight and very particularly preferably less than 0.3% by weight in total, based in each case on the total weight of the aqueous dispersion. The aqueous dispersions of water-soluble polymers of N-vinylcarboxamides preferably have a high polymer content and preferably comprise polymers having high molar masses and simultaneously a low viscosity.

The cationic polymer having a charge density of below 3 mEq per gram and an intrinsic viscosity of at least 4 dl/g desirably may be prepared using a water-soluble ethylenically unsaturated monomer or blend of water-soluble ethylenically unsaturated monomers in which at least one of the monomers is cationic. Where the polymers are formed from more than one monomer the other monomers may be either cationic or non-ionic or a mixture, although it may be desirable for said monomers to include one or more anionic monomers resulting in an amphoteric polymer, provided that the overall charge is cationic. Nevertheless it is preferred that the two polymeric retention aids are formed entirely from cationic monomer or a mixture of monomers containing at least one cationic monomer and at least one non-ionic monomer.

The cationic monomers include dialkylamino alkyl (meth) acrylates, dialkylamino alkyl (meth) acrylamides, including acid addition and quaternary ammonium salts thereof, diallyl dimethyl ammonium chloride. Preferred cationic monomers include the methyl chloride quaternary ammonium salts of dimethylamino ethyl acrylate and dimethyl aminoethyl methacrylate. Suitable non-ionic monomers include unsaturated nonionic monomers, for instance acrylamide, methacrylamide, hydroxyethyl acrylate, N-vinylpyrrolidone. A particularly preferred polymer includes the copolymer of acrylamide with the methyl chloride quaternary ammonium salts of dimethylamino ethyl acrylate.

This cationic polymer preferably contains at least 5 mol % cationic monomer units and up to 60 mol % cationic monomer units, more preferably between 5 and 40 mol % cationic monomer units, especially between 5 and 20 mol %. A particularly preferred first polymeric retention aids are also cationic polyacrylamides comprising acrylamide and at least one water-soluble cationic ethylenically unsaturated monomer, preferably quaternary ammonium salts of dialkyl amino alkyl (meth)—acrylates or N-substituted—acrylamides, especially the methyl chloride quaternary ammonium salts of dimethylamino ethyl acrylate.

Preferably the first polymeric retention aid exhibits an intrinsic viscosity of at least 5 and often at least 6 dl/g. In many cases it may be at least 7 or even at least 8.5 or 9 dl/g, and often at least 10 dl/g and more preferably at least 12 dl/g and particularly at least 14 or 15 dl/g. There is no maximum molecular weight necessary for the this cationic polymer of charge density below 3 mEq per gram and so there is no particular upper value of intrinsic viscosity. In fact the intrinsic viscosity may even be as high as 30 dl/g or higher. Generally though the first polymeric retention aid often has an intrinsic viscosity of up to 25 dl/g, for instance up to 20 dl/g.

Intrinsic viscosity of polymers may be determined by preparing an aqueous solution of the polymer (0.5-1% w/w) based on the active content of the polymer. 2 g of this 0.5-1% polymer solution is diluted to 100 ml in a volumetric flask with 50 ml of 2M sodium chloride solution that is buffered to pH 7.0 (using 1.56 g sodium dihydrogen phosphate and 32.26 g disodium hydrogen phosphate per liter of deionised water) and the whole is diluted to the 100 ml mark with deionised water. The intrinsic viscosity of the polymers is measured using a Number 1 suspended level viscometer at 25° C. in 1M buffered salt solution. Intrinsic viscosity values stated are determined according to this method unless otherwise stated.

Desirably the polymers of either or both of the first and/or second polymeric retention aids may be provided as reverse-phase emulsions prepared by reverse phase emulsion polymerisation, optionally followed by dehydration under reduced pressure and temperature and often referred to as azeotropic dehydration to form a dispersion of polymer particles in oil. Alternatively the polymer may be provided in the form of beads and prepared by reverse phase suspension polymerisation, or prepared as a powder by aqueous solution polymerisation followed by comminution, drying and then grinding. The polymers may be produced as beads by suspension polymerisation or as a water-in-oil emulsion or dispersion by water-in-oil emulsion polymerisetion, for example according to a process defined by EP-A-150933, EP-A-102760 or EP-A-126528.

Generally the two different cationic polymers that form the cationic polymer blend may be each made into aqueous solutions separately before being combined. Alternatively, it may be desirable in some instances to make the polymer blend by dissolving the two different cationic polymers together. Typically aqueous solutions of the two polymeric retention aids may be achieved by individually dissolving the respective polymers into water. This may for instance be achieved in a suitable polymer solution make up device. Such equipment is described in the prior art and for instance commercialised by BASF under the trademark Jet Wet™.

One convenient way of preparing the blend is by flowing one of the cationic polymers into a feed line carrying the other cationic polymer form a blend of the two polymers which is then delivered into the cellulosic thin stock suspension. Alternatively, it may be desirable to combine the two polymers and then to store the blend in a storage vessel, for subsequent delivery to the thin stock suspension.

The blend of cationic polymers, which is generally present as an aqueous blend, may contain the cationic polymer having a charge density of at least 3 mEq per gram at a concentration of at least 0.05% and often up to 10% or 20% or 30% or more, for instance at least 1% or at least 2% (based on total weight of blend) and the cationic polymer with a charge density of below 3 mEq per gram at a concentration of at least 0.05%, at least 0.1% or at least 0.2% and often up to 1% or 2%, although in some cases it may be desirable for the concentration to be as much as 5% (based on total weight of blend). The exact ratio of the two different cationic polymers will depend upon the desired dosage required for each respective cationic polymer. Generally the dose of cationic polymer of charge density at least 3 mEq per gram may be at least 50 ppm and often at least 100 ppm. Frequently the dose will be at least 200 ppm and in some cases at least 500 ppm. The dose may be as high as 3000 ppm or higher but often will be up to 2500 ppm and in some cases up to 2000 ppm. Usually the dose of cationic polymer of charge density below 3 mEq per gram may be at least 50 ppm and frequently at least 100 ppm. Typical doses may be up to 1000 ppm although doses in the range of at least 150 ppm or at least 200 ppm up to a dose of 600 ppm may often be particularly suitable. All dosages of the respective cationic polymers based on the active weight of cationic polymer on the dry weight of cellulosic thin stock suspension.

The microparticulate material employed in the present invention may be any suitable finely divided particulate material. Suitably it may be selected from the group consisting of silica based particles, silica microgels, colloidal silica, silica sols, silica gels, polysilicates, cationic silica, aluminosilicates, polyaluminosilicates, borosilicates, polyborosilicates, zeolites, bentonite, hectorite, smectites, montmorillonites, nontronites, saponite, sauconite, hormites, attapulgites, sepiolites, anionic cross-linked polymeric microparticles of particle size below 750 nm and nanocellulose.

The silica may be for example any colloidal silica, for instance as described in WO-A-8600100. The polysilicate may be a colloidal silicic acid as described in U.S. Pat. No. 4,388,150. Polysilicates may be prepared by acidifying an aqueous solution of an alkali metal silicate. The polyaluminosilicates may be for instance aluminated polysilicic acid, made by first forming polysilicic acid microparticles and then post treating with aluminium salts, for instance as described in U.S. Pat. No. 5,176,891. Such polyaluminosilicates consist of silicic microparticles with the aluminium located preferentially at the surface.

Alternatively the polyaluminosilicates may be polyparticulate polysicilic microgels of surface area in excess of 1000 $m^2/g$ formed by reacting an alkali metal silicate with acid and water soluble aluminium salts, for instance as described in U.S. Pat. No. 5,482,693. Typically the polyaluminosilicates may have a mole ratio of alumina:silica of between 1:10 and 1:1500.

The siliceous material may be a colloidal borosilicate, for instance as described in WO-A-9916708.

The swellable clays may for instance be typically a bentonite type clay. The preferred clays are swellable in water and include clays which are naturally water swellable or clays which can be modified, for instance by ion exchange to render them water swellable. Suitable water swellable clays include but are not limited to clays often referred to as hectorite, smectites, montmorillonites, nontronites, saponite, sauconite, hormites, attapulgites and sepiolites. Typical anionic swelling clays are described in EP-A-235893 and EP-A-335575.

Most preferably the clay is a bentonite type clay. The bentonite may be provided as an alkali metal bentonite. Bentonites occur naturally either as alkaline bentonites, such as sodium bentonite or as the alkaline earth metal salt, usually the calcium or magnesium salt. Generally the alkaline earth metal bentonites are activated by treatment with sodium carbonate or sodium bicarbonate. Activated swellable bentonite clay is often supplied to the paper mill as dry powder. Alternatively the bentonite may be provided as a high solids flowable slurry, for example at least 15 or 20% solids, for instance as described in EP-A-485124, WO-A-9733040 and WO-A-9733041.

The cross-linked polymeric microparticles may be made as microemulsions by a process employing an aqueous solution comprising a cationic or anionic monomer and crosslinking agent; an oil comprising a saturated hydrocarbon; and an effective amount of a surfactant sufficient to produce particles of less than about 0.75 micron in unswollen number average particle size diameter. Microbeads are also made as microgels by procedures described by Ying Huang et. al., Makromol. Chem. 186, 273-281 (1985) or may be obtained commercially as microlatices. The term "microparticle", as used herein, is meant to include all of these configurations, i.e. microbeads per se, microgels and microlatices.

The polymeric microparticles of this invention are preferably prepared by polymerization of the monomers in an emulsion as disclosed in application, EP-484617. Polymerization in microemulsions and inverse emulsions may be used as is known to those skilled in this art.

The cellulosic suspension used for making the pulp in the present invention may be made by conventional methods, for instance from wood or other feedstock. Deinked waste paper or board may be used to provide some of it. For instance the wood may be debarked and then subjected to grinding, chemical or heat pulping techniques, for instance to make a mechanical pulp, a thermomechanical pulp or a chemical pulp. The fibre may be bleached, for instance by using a conventional bleaching process, such as employing magnesium bisulphite or hydrosulphite. The pulp may have been washed and drained and rewashed with water or other aqueous wash liquor prior to reaching the final drainage stage on the pulp making machine.

The cellulosic thin stock suspension may contain mechanical fibre. By mechanical fibre we mean that the cellulosic suspension comprises mechanical pulp, indicating any wood pulp manufactured wholly or in part by a mechanical process, including stone ground wood (SGW), pressurised ground wood (PGW), thermomechanical pulp (TMP), chemithermomechanical pulp (CTMP) or bleached chemithermomechanical pulp (BCTMP). Mechanical paper grades contain different amounts of mechanical pulp, which is usually included in order to provide the desired optical and mechanical properties. In some cases the pulp used in making the filled paper may be formed of entirely of one or more of the aforementioned mechanical pulps. In addition to mechanical pulps other pulps are often included in the cellulosic suspension. Typically the other pulps may form at least 10% by weight of the total fibre content. These other pulps the included in the paper recipe include deinked pulp and sulphate pulp (often referred to as kraft pulp).

The following examples illustrate the invention.

EXAMPLES

Example 1

Confidential Trial in a Board Manufacturing Process

The mill produces folding box board on a five ply machine. The two outer plys are fourdrinier wires with 100% bleached chemical pulp and the 3 middle plys are Bell Bond formers with a 100% bleached groundwood furnish.

Machine speed depends on basis weight—lower basis weights (less than 250 gsm) usually run at higher machine speeds above 400 m/min and the higher basis weights run at lower speeds due to a steam (dryer) limitation. The retention aid in use is the Hydrocol system with the PAM added pre-screen and the bentonite added post screen. Bentonite is added with typical dosage rates of 0.9 kg/t into the outer plys and 1.2 to 1.5 kg/t into the middles plys. Cationic polyacrylamide (IV greater than 4 dl/g and charge density less than 3 mEq per gram) is added with a typical dosage rate 0.2 kg/t into the outer plys and 0.25 to 0.35 kg/t into the middles plys. These addition rates vary depending on furnish conditions and paper properties. Higher amounts of cationic polyacrylamide can not be applied due to adverse effects in both sheet formation and strength properties. With an extra addition of 2 kg/t of HM Polymin (polyethyleneimine with a charge density greater than 3 mEq per gram and a molar mass of greater than 700,000 Da) into the final dilution water of the aforementioned cationic polyacrylamide to form a cationic polymer blend (Polymix) in the middle plys only the machine speed and production increased by 4% on a Folding Box Board grade with a basis weight of 350 g/m$^2$. The aforementioned cationic polymer blend gave improved press dewatering with the same formation and strength values.

Example 2

Confidential Trial in a Board Manufacturing Process at a Different Location from that of Example 1

The mill produces various grades of Kraft Liner on a two ply fourdrinier machine. The top ply furnish is always 100% unbleached kraft pulp and the base ply is a variable ratio of waste paper and unbleached kraft from 100% waste to a minimum 50% waste. Machine speed depends on basis weight—lower basis weights (less than 125 gsm) usually run at a maximum machine speed of 800 m/min and the higher basis weights run at lower speeds due to a steam (dryer) limitation. The retention aid in use is the Hydrocol system with the cationic polyacrylamide (IV greater than 4 dl/g and charge density less than 3 mEq per gram) added pre-screen and the bentonite added post screen. Bentonite is added with typical dosage rates of 1.4 to 2 kg/t into the top ply and 3.0 kg/t into the bottom ply. Cationic polyacrylamide is added with a typical dosage rate of 0.1 to 0.25 kg/t into the top ply and 0.25 to 0.4 kg/t into the bottom ply. These addition rates vary depending on furnish conditions and paper properties. Higher amounts of cationic polyacrylamide can not be applied due to adverse effects in both sheet formation and strength properties. With an extra addition of 1 kg/t of HM Polymin (polyethyleneimine as described above) into the final dilution water of the PAM to form a cationic polymer blend (Polymix) on both plys of the machine speed and production increased by 5% on a Kraft Liner grade with a basis weight of 140 g/m$^2$. The addition of the cationic polymer blend gave improved press dewatering with the same formation and strength values.

The invention claimed is:

1. A process of making paper or paperboard, comprising:

shearing a cellulosic thin stock, adding a retention system to the cellulosic thin stock, draining the cellulosic thin stock on a moving screen to form a wet sheet, and drying the wet sheet, wherein (1) the retention system comprises as components:

(i) a blend of different cationic polymers, and (ii) a microparticulate material selected from the group consisting of silica-based particles, swellable clays and mixtures thereof, (2) the blend of different cationic polymers comprises:

(a) a cationic polymer having a charge density of at least 3 mEq per gram and a molar mass of greater than 1,100,000 Da, wherein the cationic polymer (a) is selected from the group consisting of polyethyleneimines, modified polyethyleneimines, polyvinylamines, partially hydrolyzed polyvinyl carboxamides and mixtures thereof, (b) a cationic polymer having a charge density of below 3 mEq per gram and an intrinsic viscosity of at least 4 dl/g, wherein the cationic polymer (b) comprises 5 to 40 mol % of a cationic monomer selected from the group consisting of cationic polyacrylamides comprising acrylamide, a methyl chloride quaternary ammonium salt of dimethylamino ethyl acrylate and mixtures thereof, and (c) an aqueous medium, (3) one of the components of the retention system (i) or (ii) is dosed into the cellulosic thin stock after a final shearing stage and the other component is dosed into the cellulosic thin stock before the final shearing stage, (4) the blend of different cationic polymers comprises 0.05% to 30% by weight of cationic polymer (a), based on the total weight of the blend of different cationic polymers, (5) the blend of different cationic polymers comprises 0.05% to 2% by weight of cationic polymer (b), based on the total weight of the blend of different cationic polymers, (6) the dose of cationic polymer (a) is 50 to 3000 ppm, based on the active weight of cationic polymer (a) on the dry weight of the cellulosic thin stock, and (7) the dose of cationic polymer (b) is 50 to 1000 ppm, based on the active weight of cationic polymer (b) on the dry weight of the cellulosic thin stock.

2. The process of claim 1, wherein the blend of cationic polymers (i) is dosed into the thin stock prior to the final shearing stage and the microparticulate material (ii) is dosed into the thin stock after the final shearing stage.

3. The process of claim 1, wherein the blend of cationic polymers (i) is dosed into the thin stock after the final shearing stage and the microparticulate material (ii) is dosed into the thin stock before the final shearing stage.

4. The process of claim 1, wherein the cationic polymer (a) is a polyethyleneimine.

5. The process of claim 1, wherein the cationic polymer (a) is a modified polyethyleneimine.

6. The process of claim 1, wherein the cationic polymer (a) is a polyvinylamine.

7. The process of claim 1, wherein the cationic polymer (a) is a partially hydrolyzed polyvinyl carboxamide.

8. The process of claim 1, wherein the cationic polymer (b) comprises (bii) a water-soluble non-ionic ethylenically unsaturated monomer selected from the group consisting of acrylamide and methacrylamide.

9. The process of claim 1, wherein the microparticulate material (ii) is a silica-based particle.

10. The process of claim 1, wherein the microparticulate material (ii) is a swellable clay.

11. The process of claim 1, wherein the microparticulate material is bentonite.

12. The process of claim 1, wherein the paper or paperboard is a single-ply sheet.

13. The process of claim 1, wherein the paper or paperboard is a multi-ply sheet.

14. The process of claim 1, wherein the blend of different cationic polymers (i) comprises 0.05% to 20% by weight of cationic polymer (a) and 0.05% to 1% by weight of cationic polymer (b), based on the total weight of the blend.

15. The process of claim 1, wherein the blend of different cationic polymers (i) comprises 0.05% to 20% by weight of cationic polymer (a), based on the total weight of the blend.

16. The process of claim 1, wherein the dose of cationic polymer (a) is 50 ppm to 2500 ppm and the dose of cationic polymer (b) is 50 ppm to 600 ppm, based on the active weight of cationic polymer on the dry weight of cellulosic thin stock.

17. The process of claim 1, wherein the dose of cationic polymer (a) is 50 ppm to 2000 ppm and the dose of cationic polymer (b) is 50 ppm to 600 ppm, based on the active weight of cationic polymer on the dry weight of cellulosic thin stock.

18. The process of claim 1, wherein the dose of cationic polymer (a) is 200 ppm to 3000 ppm, based on the active weight of cationic polymer on the dry weight of cellulosic thin stock.

19. The process of claim 1, wherein the dose of cationic polymer (a) is 500 ppm to 3000 ppm, based on the active weight of cationic polymer on the dry weight of cellulosic thin stock.

* * * * *